US005523050A

United States Patent [19]

Lloyd et al.

[11] Patent Number: 5,523,050

[45] Date of Patent: Jun. 4, 1996

[54] METHOD OF PREPARING IMPROVED EUTECTIC OR HYPER-EUTECTIC ALLOYS AND COMPOSITES BASED THEREON

[75] Inventors: David J. Lloyd; Iljoon Jin, both of Kingston, Canada

[73] Assignee: Alcan International Limited, Montreal, Canada

[21] Appl. No.: 32,437

[22] Filed: Mar. 15, 1993

Related U.S. Application Data

[63] Continuation of Ser. No. 800,071, Nov. 27, 1991, abandoned, which is a continuation of Ser. No. 770,124, Oct. 2, 1991, abandoned.

[30] Foreign Application Priority Data

Nov. 27, 1990 [CA] Canada ..... 2030928

[51] Int. Cl.[6] ..... C22C 21/00; C22C 1/00

[52] U.S. Cl. ..... 420/528; 148/415; 148/417; 148/437; 148/439; 148/440; 420/534; 420/535; 420/537; 420/538; 420/544; 420/546; 420/547; 420/548; 420/550; 420/551; 420/552; 420/590; 428/621; 428/627; 428/632

[58] Field of Search ..... 148/415, 437, 148/440, 417, 439; 420/528, 590, 534, 535, 537, 538, 544, 546, 547, 548, 550, 551, 552, 621, 627, 632

[56] References Cited

U.S. PATENT DOCUMENTS 4,753,690 6/1988 Wada et al. ..... 148/415
4,959,276 9/1990 Hagiwara et al. ..... 428/614

FOREIGN PATENT DOCUMENTS 59-173234 10/1984 Japan .

OTHER PUBLICATIONS

P. K. Rohatgi et al., "Solidification, Structures, and properties of cast metal–ceramic particle composites," *Internat'l Metals Rev.*, 31 (3), pp. 115–139/Dec. 1986.

S. Das et al., "Some Modified Structures of the Matrix in Cast Al–Alloy–Graphite Particle Composites," *Z. Metallkde.*, 80 (Dec. 1989) H. 6, pp. 444–446.

I. Jin et al., "Solidification of SiC Particulate Reinforced Al–Si Alloy Composites," *Fabrication of Particulate Reinforced Metal Composites*, ASM–International, pp. 47–52 [Nov. 1, 1990].

*Primary Examiner*—David A. Simmons
*Assistant Examiner*—Robert R. Koehler
*Attorney, Agent, or Firm*—Cooper & Dunham

[57] ABSTRACT

A method is described for preparing a refined or reinforced eutectic or hyper-eutectic metal alloy, comprising: melting the eutectic or hyper-eutectic metal alloy, adding particles of non-metallic refractory material to the molten metal matrix, mixing together the molten metal alloy and the particles of refractory material, and casting the resulting mixture under conditions causing precipitation of at least one intermetallic phase from the molten metal matrix during solidification thereof such that the intermetallics formed during solidification wet and engulf said refractory particles. The added particles may be very small and serve only to refine the precipitating intermetallics in the alloy or they may be larger and serve as reinforcing particles in a composite with the alloy. The products obtained are also novel.

33 Claims, 8 Drawing Sheets

500 X

500X

500 X

400X

400X

400X

500X

200X

400X

METHOD OF PREPARING IMPROVED EUTECTIC OR HYPER-EUTECTIC ALLOYS AND COMPOSITES BASED THEREON

This application is a continuation of Ser. No. 800,071, filed Nov. 27, 1991, now abandoned, which is a continuation of Ser. No. 770,124, filed Oct. 2, 1991 (now abandoned).

BACKGROUND OF THE INVENTION

This invention relates to a method of preparing improved eutectic and hyper-eutectic alloys and metal matrix composites containing such alloys.

Metal matrix composite materials have gained increasing acceptance as structural materials. Such composites typically are composed of reinforcing particles, such as fibres, grit, powder or the like that are embedded within a metallic matrix. The reinforcement imparts strength, stiffness and other desirable properties to the composite, while the matrix protects the fibres and transfers load within the composite. The two components, matrix and reinforcement, thus cooperate to achieve results which are improved over what either could provide on its own. A typical composite is an aluminum alloy reinforced with particles of silicon carbide or alumina.

A major difficulty in the production of good quality metal matrix composites is segregation of the reinforcing particles. The segregation of particles occurs in the liquid state as well as during solidification. The segregation in the liquid state can be overcome by a proper mixing of the liquid. However, even if the particles are uniformly distributed in the liquid state, they may still segregate during solidification. When metal matrix composites are in the process of solidifying, the reinforcing particles can be rejected ahead of the solidification interface, and may agglomerate in the interdendritic liquid which solidifies last. For instance, in aluminum matrix composites, solid α-aluminum dendrites are formed and the reinforcing particles are pushed ahead of the growing dendrites to be finally trapped in the last to solidify interdendritic liquid. The reinforcing particles are not found inside the aluminum dendrites and, in this sense, it can be said that the aluminum dendrites do not "wet" the reinforcing particles. This results in a highly inhomogeneous distribution of reinforcing particles in the as-cast materials.

Whether reinforcement particles are pushed by the solidification interface or are engulfed is primarily dependent upon the degree of wetting between the particles and the solid surface. If the solid surface wets the particles, they are engulfed by the solid surface. In this case the particle distribution in the solidified material is as uniform as it was in the liquid state. On the other hand, if the solid surface, e.g. aluminum dendrite surface, does not wet the particles, they are pushed away, resulting in interdendritic segregation.

In certain alloy systems, such as eutectic or hyper-eutectic systems, intermetallic compounds may precipitate directly from a melt of the alloy. These intermetallic compounds often tend to be coarse, brittle particles, and these particles tend to segregate due to density difference, particularly when the solidification rate is slow.

There is some evidence in the prior art of a degree of wetting between refractory particles and intermetallic surfaces. For instance P. K. Rohatgi, "Interfaces in Metal Matrix Composites", p. 185, The Metallurgical Society/AIME, New Orleans, 2–6 Mar. 1986, has shown an example of primary $NiAl_3$ nucleating on graphite particles during the solidification of a hyper-eutectic Al-Ni alloy. He also noted that there is a tendency for primary Si to nucleate on graphite and alumina particles during the solidification of a hyper-eutectic Al-Si alloy.

Solidification studies of grain refining Al-Ti-B alloys are described in K. Kuisalaas and L. Backerud, Solidification Process 1987, p. 137, Institute of Metals, Sheffield, U.K., 21–24 Sep. 1987. These studies noted that $TiAl_3$ intermetallics tended to adhere to the surface of $TiB_2$ particles.

A study on aluminum alloys for elevation temperature applications is described in D. A. Granger et al., "Aluminum Alloys for Elevated Temperature Applications" p. 777–778, AFS Transactions, 86–143. Traditionally, casting alloys for elevated temperature applications were made by adding large amounts of Cu or Ni, e.g. up to about 8 wt % Cu and 5.5 wt % Ni. It has been generally understood that high volume fractions of the intermetallics so formed improve the high temperature properties. However, the amount of these elements which could be added was restricted because they formed large brittle intermetallic primaries on solidification if the addition was beyond a certain limit. The amount of Mn that could be added was limited to less than 0.5 wt %.

It is the object of the present invention to provide a technique for improving eutectic and hyper-eutectic alloys and for solving the problem of the segregation of the reinforcement particles in metal matrix composites made from eutectic or hyper-eutectic alloys which tends to occur during solidification. It is a further object of the invention to produce new alloy products having improved high temperature properties.

SUMMARY OF THE INVENTION

According to the present invention, it has now been discovered that non-metallic refractory particles when added to a molten eutectic or hyper-eutectic alloy can be "wetted" or engulfed during solidification by causing at least one intermetallic phase to solidify first from the molten alloy during solidification thereof such that the refractory particles are wetted and engulfed by the intermetallic phase as it grows during solidification. Because the intermetallics wet and engulf the refractory particles, there is no longer a tendency for the refractory particles to segregate to the interdendritic regions and they remain homogeneously distributed throughout an as-solidified ingot.

In one embodiment of the invention, the refractory particles act as a refiner for precipitating intermetallics. The use of unreinforced hyper-eutectic alloys is very restricted because they often form coarse, brittle intermetallic particles on solidification, and the intermetallic particles tend to segregate due to the density difference, particularly when the solidification rate is not rapid. For instance, in commercial hyper-eutectic Al-Si alloys, such as A390 alloy, used for engine block applications, phosphorus additions and fluxing have previously been required to refine the primary silicon to a size suitable for good wear properties. However, the efficiency of phosphorus to refine primary silicon decreases with increasing holding time of the melt, complicating the casting practice. On the other hand, the addition of refractory particles, such as silicon carbide particles, according to the present invention can nucleate and refine these intermetallics, as well as modify their morphology, so that the deleterious effect of coarse intermetallics is reduced. This is of particular value for alloys that are intended for high temperature use.

There is a need for aluminum alloy products capable of extended use at high temperatures. Such high temperature alloys may be used in casting applications, or as wrought products, such as forgings and extrusions. The alloy composites of this invention in which the refractory particles act as a refiner for precipitating intermetallics have superior high temperature strength, making them useful for applications such as cast brake rotors.

According to a further embodiment, the refractory particles may also serve as reinforcing particles in a composite with the eutectic or hyper-eutectic alloy. Thus, they may be used not only to refine a eutectic or hyper-eutectic alloy, but also to form a composite therewith. When the particles are used solely to refine an alloy, they are typically used in very small, e.g. sub-micron, sizes. On the other hand, when they are used also for reinforcing the alloy, they may be used in much larger sizes, e.g. up to 20 microns. For reinforcing, they are typically used in sizes in the range of 5–20 microns and preferably 10–15 microns. When the particles are used in reinforcing sizes, the wetting and engulfment of them by the intermetallic phase prevent the problem of segregating to the interdendritic regions during cooling.

Preferably the eutectic or hyper-eutectic alloy is an aluminum alloy, although other materials such as magnesium alloys can also be used. The non-metallic refractory material is preferably a metal oxide, metal nitride, metal carbide or metal silicide. The most preferred refractory material is silicon carbide or aluminum oxide particulate.

The procedure of the present invention for making a composite functions best with reinforcing particles which are relatively equi-dimensional, e.g. having an aspect ratio in any direction of no more than 5:1. The reinforcing particles are typically added in amounts of 5–40% by volume, preferably 10–25% by volume. In accordance with a preferred feature of the present invention, it has been found that silicon carbide reinforcing particles are engulfed by silicon crystals formed during solidification of the composite.

The invention also relates to new aluminum alloy products having improved high temperature properties. One of the novel products is a particle reinforced aluminum alloy casting in which non-metallic refractory reinforcing particles are uniformly dispersed by being wetted by intermetallics formed during solidification. Another novel product is a refined aluminum alloy casting in which intermetallics formed during solidification are uniformly dispersed as fine particles because of the refining effect of particles of non-metallic refractory material contained in the alloy.

The alloy of the novel products is an eutectic or hyper-eutectic aluminum alloy containing silicon, magnesium and manganese, preferably in the amounts 7–16 wt % silicon, 0.3–2.0 wt % magnesium and 0.5–3.0 wt % manganese. The silicon assists fluidity and stabilizes the refractory particles; below 7% silicon the refractory material tends to be unstable while above 16% coarse intermetallics are formed and the composite becomes embrittled. The magnesium improves wetting and provides strengthening; below 0.3% magnesium the wetting is poor, while above 2% there is shrinkage porosity. The manganese forms intermetallics providing uniform refractory particle distribution and improved high temperature strength; below 0.5% manganese there is no improvement in high temperature strength and above 3.0% the casting temperature becomes too high.

The alloy also preferably contains up to 5.0 wt % copper. This improves elevated temperature strength with amounts above 5.0% providing poor casting fluidity and embrittlement. Another optional component is nickel which may also be present in amounts up to 5.0 wt %. It also improves elevated temperature strength, although amounts above 5.0% cause coarse intermetallics and embrittlement.

A further common optional element is iron which may be present in amounts up to 1.0 wt %. At amounts above 1.0 wt % there is the danger of forming coarse intermetallics which cannot be refined by the refractory particles.

The alloy may also contain up to 0.2 wt %, preferably 0.1–0.2 wt %, titanium as a grain refiner.

A series of aluminum alloys and the intermetallic phases that precipitate therefrom which are useful according to this invention are shown in Table 1 below:

TABLE 1

| Alloy | Intermetallic |
|---|---|
| Al—16 wt% Si— | Si |
| Al—12 wt% Si—1.5 wt% Fe | $FeSiAl_5$ |
| Al—7 wt% Si—2 wt% Fe | $Fe_2SiAl_8$ |
| Al—12 wt% Si—1.5 wt% Mn | $Mn_3Si_2Al_{15}$ |
| Al—11 wt% Si—5 wt% Ni | $NiAl_3$ |
| Al—10 wt% Si—10 wt% Mg | $Mg_2Si$ |
| Al—10 wt% Si—2 wt% Cr | $Cr_5Si_8Al_2$ |
| Al—16 wt% Si—0.3 wt% Ti | $Ti(AlSi)_2$ |
| Al—10 wt% Si—0.5 wt% Zr | $ZrAl_3$ |

Alloys of particular interest for high temperature applications are those containing substantial amounts of Mn. Such alloys may be produced by adding Mn to traditional high temperature alloy compositions until the eutectic or hypereutectic range is reached. This is mixed with refractory particles, e.g. which refine the intermetallics and distribute the particles uniformly throughout the matrix.

Examples of new composites thus produced are given in Table II below:

Table II

Al-10 wt % Si-1.2 wt % Mn-0.4 wt % Mg-15 vol % SiC

Al-10 wt % Si-1.2 wt % Mn-0.4 wt % Mg-5 wt % Ni-15 vol % SiC

Al-10 wt % Si-1.2 wt % Mn-1.0 wt % Mg-5 wt % Ni-2.5 wt % Cu-15 vol % SiC

While a typical intermetallic is a compound formed of at least two metallic components, within the process of this invention, silicon behaves in the manner of an intermetallic in its ability to wet and engulf refractory particles. Accordingly, the term "intermetallic" as used in this invention includes silicon.

BRIEF DESCRIPTION OF THE DRAWINGS

In the drawings which illustrate the present invention.

EXAMPLE 1

Figure 1:
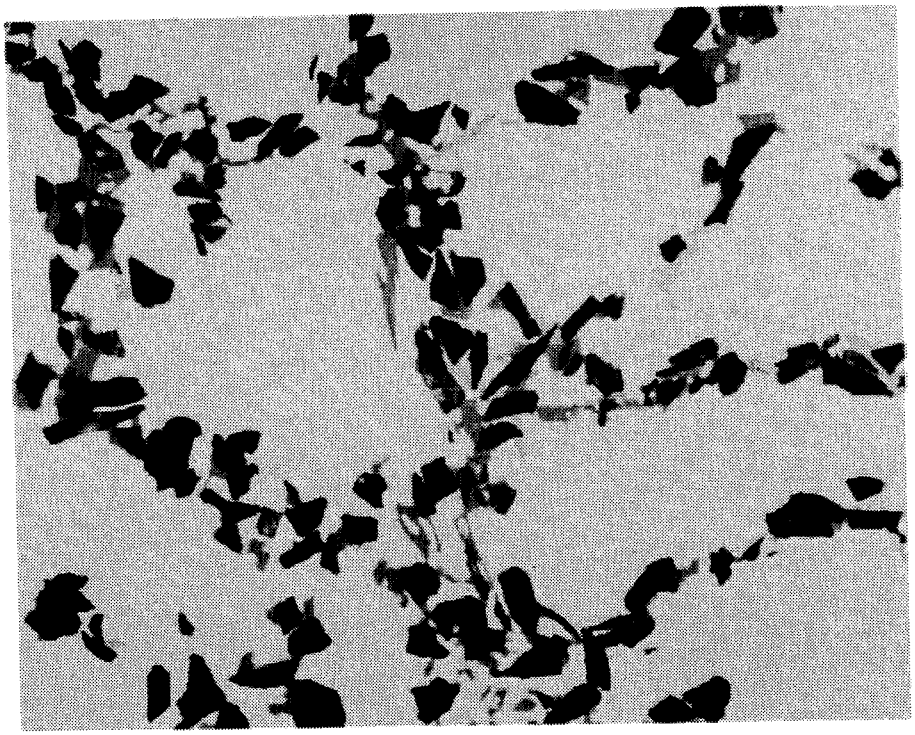
FIG. 1 is a photomicrograph of an A-356 alloy casting with refractory particles.

An aluminum matrix composite was prepared by mixing 15% by volume of silicon carbide particles having sizes in the range of 10–15 μm with a melt of A356 aluminum alloy containing 6.5 to 7.5% Si and 0.3 to 0.45% Mg. This was cast and solidified to form an ingot having the microstructure shown in FIG. 1. It will be seen that the reinforcing particles have been pushed ahead of the solidification interface and are not uniformly dispersed throughout the ingot.

EXAMPLE 2

Figure 2:
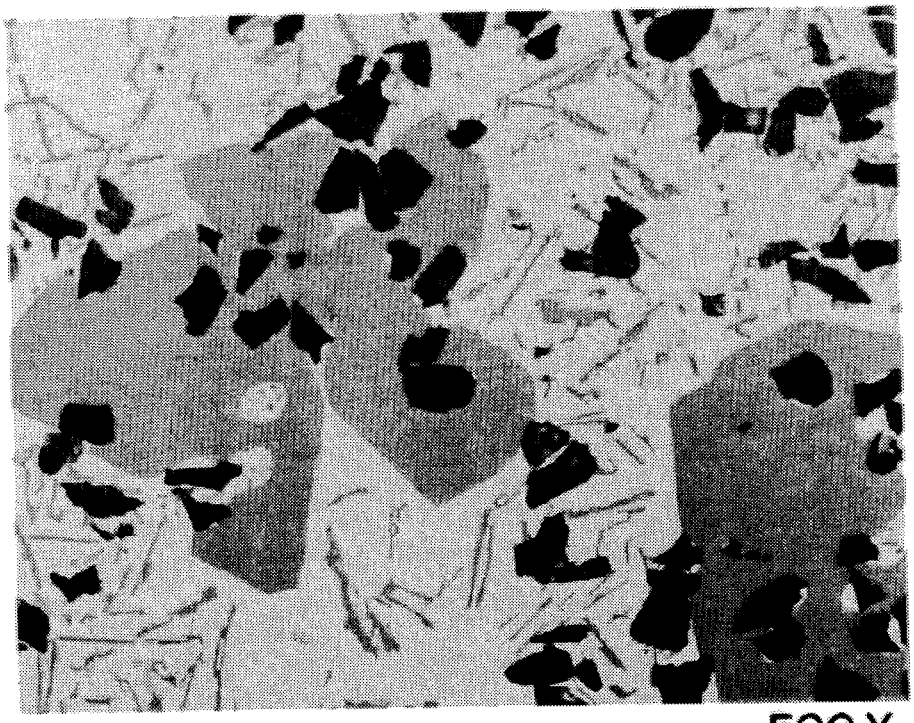
FIGS. 2–7 are photomicrographs of hyper-eutectic castings with refractory particles according to the invention.

(a) Another ingot was prepared from a melt of Al-16% Si alloy and 15% by volume of silicon carbide particles having particle sizes in the range of 10–15 μm. These were thoroughly mixed and the mixture was then cast and solidified to form an ingot. The ingot formed had the microstructure shown in FIG. 2 and it will be seen that the reinforcing particles are uniformly spaced and are engulfed by silicon crystals. The silicon carbide particles also refined the silicon.

Figure 3:
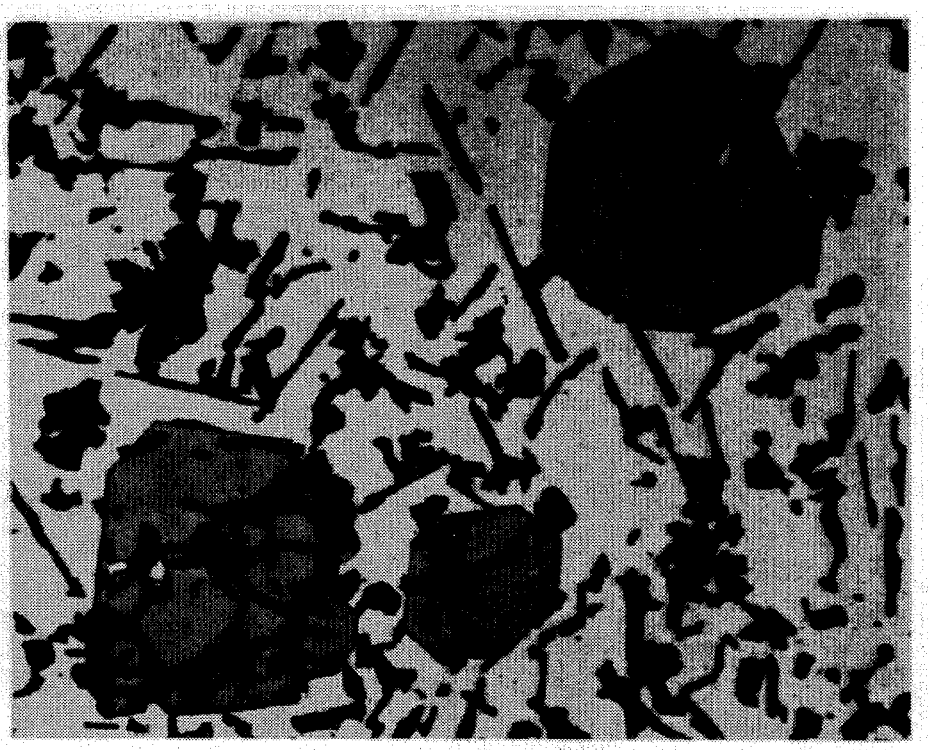

(b) The above procedure was repeated using a melt of Al-12 Si-1.5 Mn, to which was added 15% by volume of the same silicon carbide particles. The results in FIG. 3 show particle engulfment by $Mn_3Si_2Al_{15}$ crystals.

Figure 4:
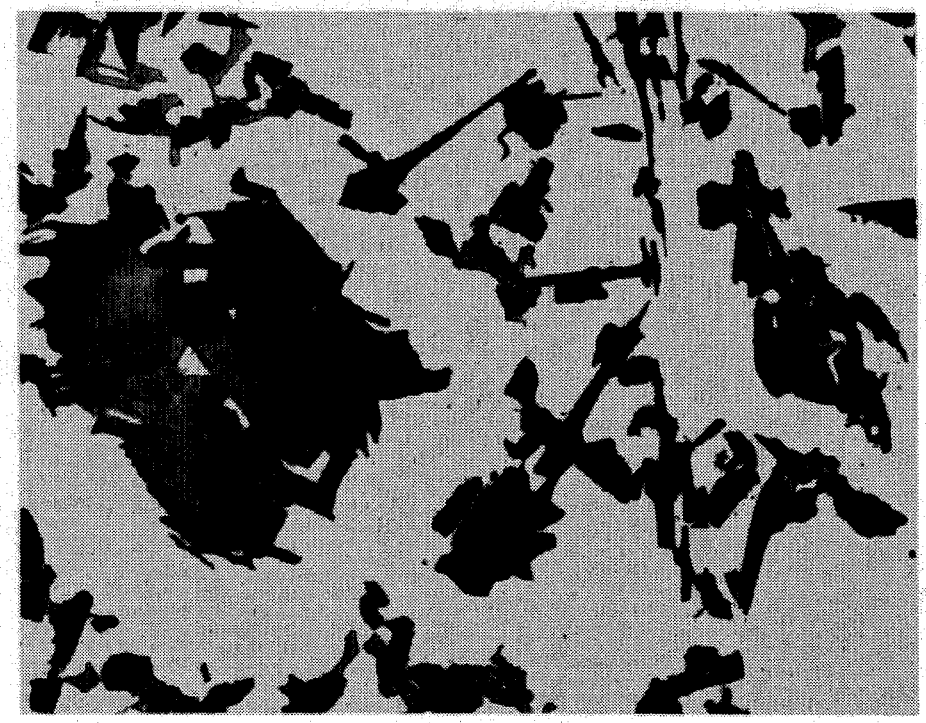

(c) The above procedure was again repeated using a melt of Al-7Si-2Fe, to which was added 15% by volume of the same silicon carbide particles. The results in FIG. 4 show particle engulfment by α-AlFeSi crystals ($Fe_2SiAl_8$).

Figure 5:
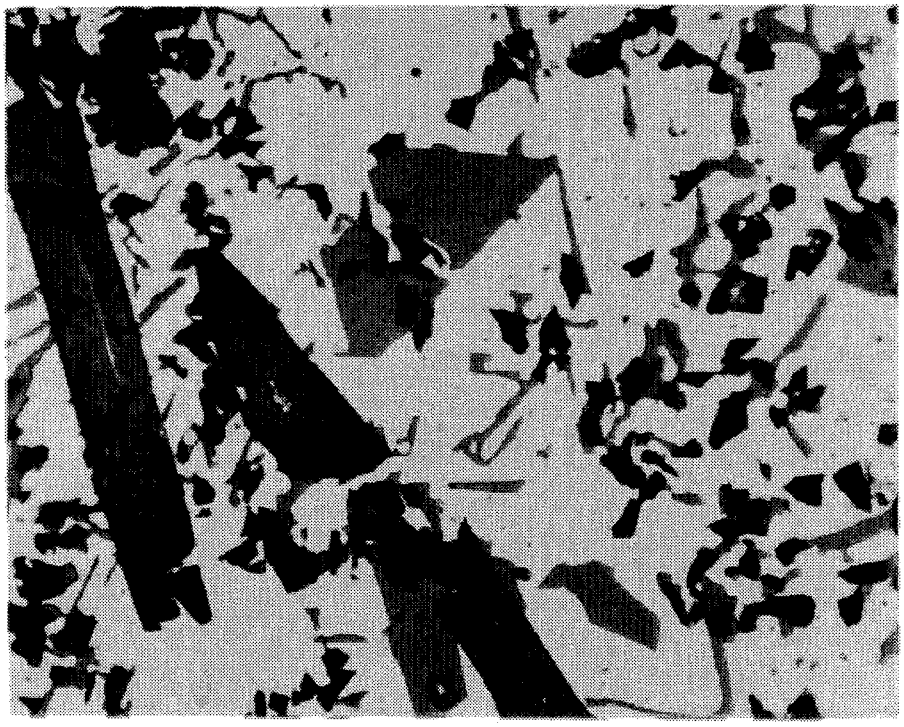

(d) The above procedure was again repeated using a melt of Al-12Si-1.5 Fe, to which was added 15% by volume of the same silicon carbide particles. The results in FIG. 5 show particle engulfment by β-AlFeSi crystals ($FeSiAl_5$).

Figure 6:
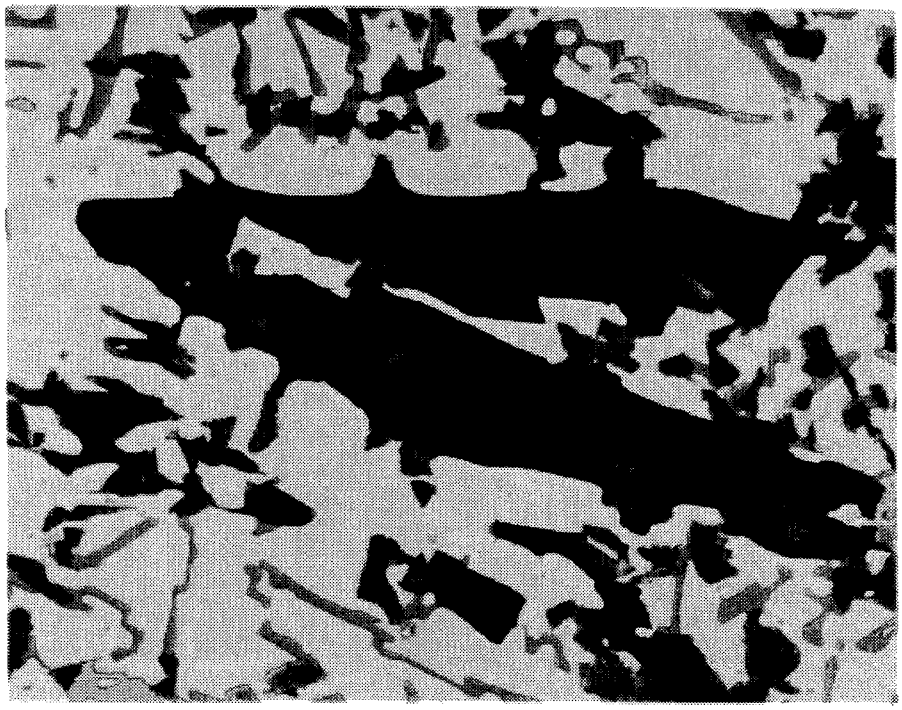

(e) The above procedure was again repeated using a melt of Al-11Si-5Ni, to which was added 15% by volume of the same silicon carbide particles. The result in FIG. 6 show particle engulfment by $NiAl_3$ crystals.

Figure 7:
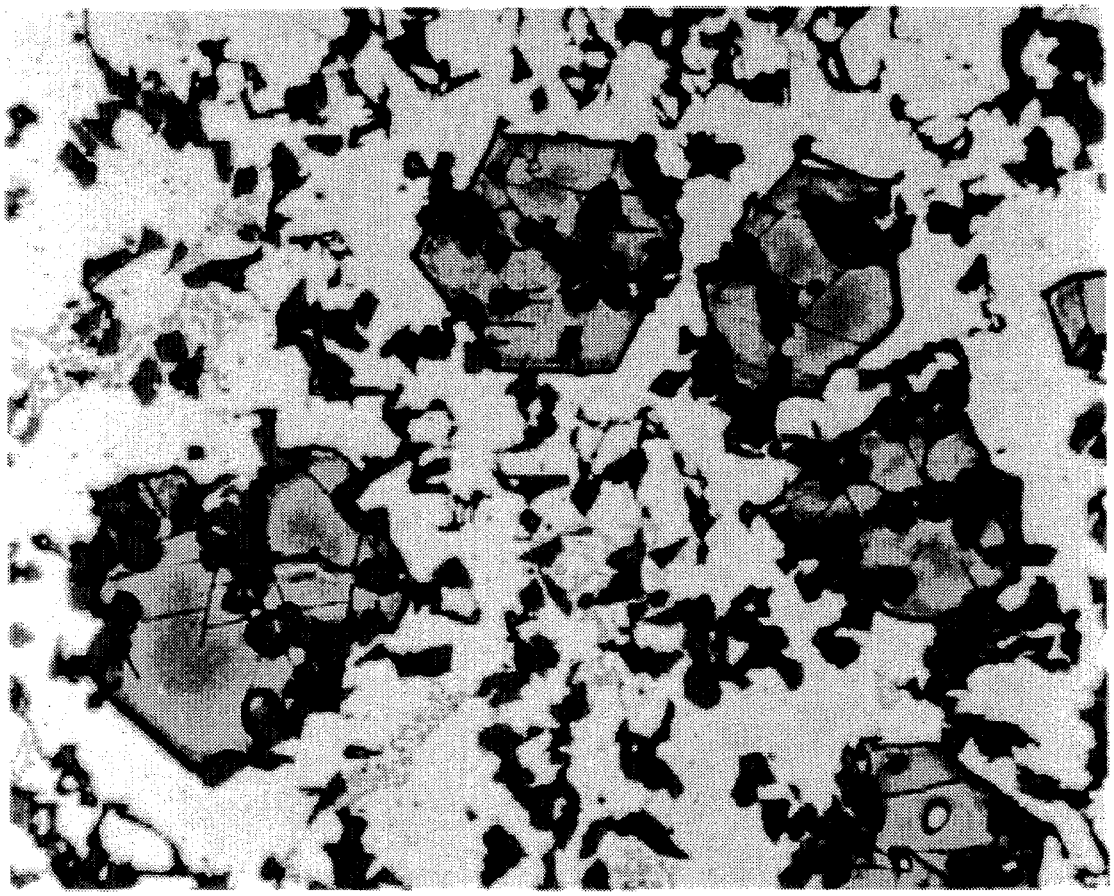

(f) The above procedure was again repeated using a melt of Al-10Si-10Mg, to which was added 15% by volume of the same silicon carbide particles. The results in FIG. 7 show particle engulfment by $Mg_2Si$ crystals.

EXAMPLE 3

Figure 8:
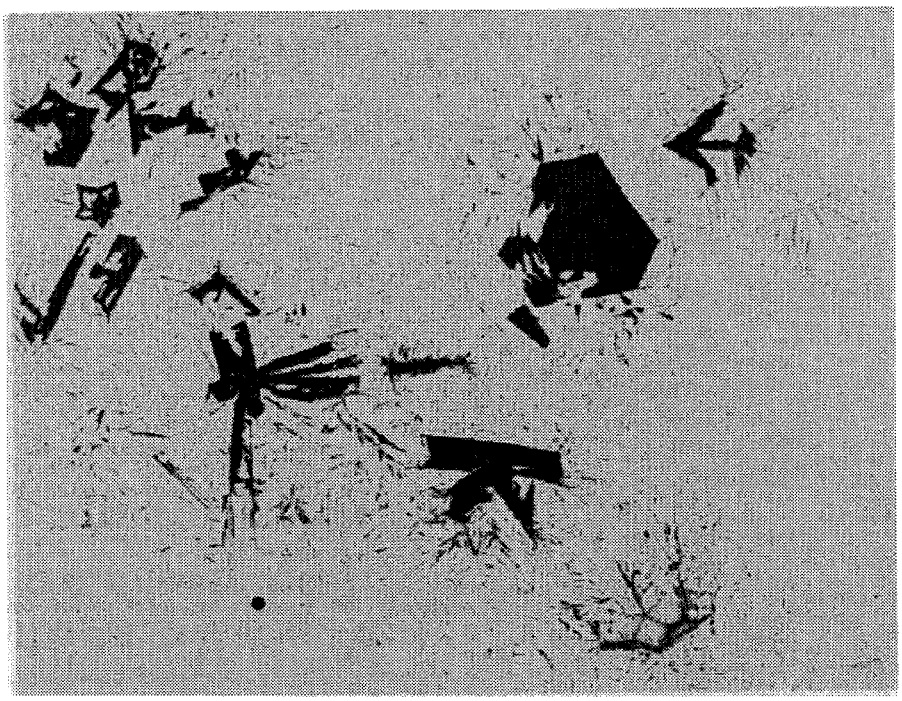
FIG. 8 is a photomicrograph of a hyper-eutectic alloy casting without refractory particles.
Figure 9:
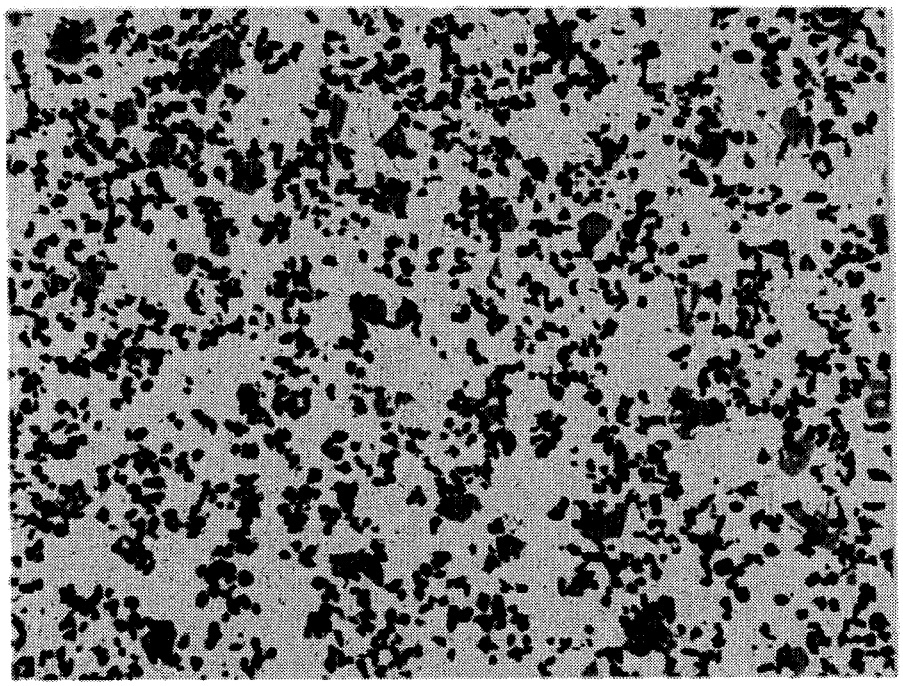
FIG. 9 is a photomicrograph of a hyper-eutectic alloy casting with refractory particles.

Two melts were prepared by heating aluminum containing 16 wt % silicon to a temperature of 750° C. One melt was cast "as is" to form an ingot and a second melt was mixed with 15% by volume of silicon carbide particles having sizes in the range of 10–15 microns and then cast to form an ingot. The ingots were identical in size and were cooled and solidified under identical conditions. FIG. 8 shows the microstructure of the ingot without the refractory particles, while FIG. 9 shows the microstructure of the ingot with the refractory particles. The refinement of the silicon is clearly evident.

EXAMPLE 4

Following the same procedure as in Example 2, tests were carried out on alloy systems containing chromium, zirconium or titanium.

(a) An ingot was prepared from a melt of Al-10% Si-2% Cr alloy and 15% by volume of silicon carbide particles having particle sizes in the range of 10–15 μm. These were thoroughly mixed and the mixtures was then cast and solidified to form an ingot. From a physical examination of the ingot it was found that the intermetallic ($Cr_5Si_8Al_2$) engulfed the SiC particles. Only limited refinement took place.

(b) The above procedure was repeated using a melt of Al-16% Si-0.3% Ti, to which was added 15% by volume of the same silicon carbide particles. In the ingot formed, there was the same engulfment of the SiC particles and again there was only limited refinement.

(c) The procedure of part (a) was again repeated using a melt of Al-10% Si-0.5% Zr, to which was added 15% by volume of the same silicon carbide particles.

The $ZrAl_3$ intermetallic did engulf the silicon carbide, but there was only limited refinement.

EXAMPLE 5

A series of particle engulfment tests were carried out using alumina as the particulate.

Four different aluminum alloys were used as follows:

(a) Al-3 wt % Mn (intermetallic: $MnAl_6$)

(b) Al-16 wt % Si (intermetallic: Si)

(c) Al-3 wt % Fe (intermetallic: $FeAl_3$)

(d) Al-9 wt % Ni (intermetallic: $NiAl_3$)

To a melt of each of these was added 15% by volume of $Al_2O_3$ particles having sizes in the range of 10–15 μm and this was cast to form an ingot. Analysis of the products showed that each intermetallic engulfed the $Al_2O_3$.

EXAMPLE 6

Figure 10:
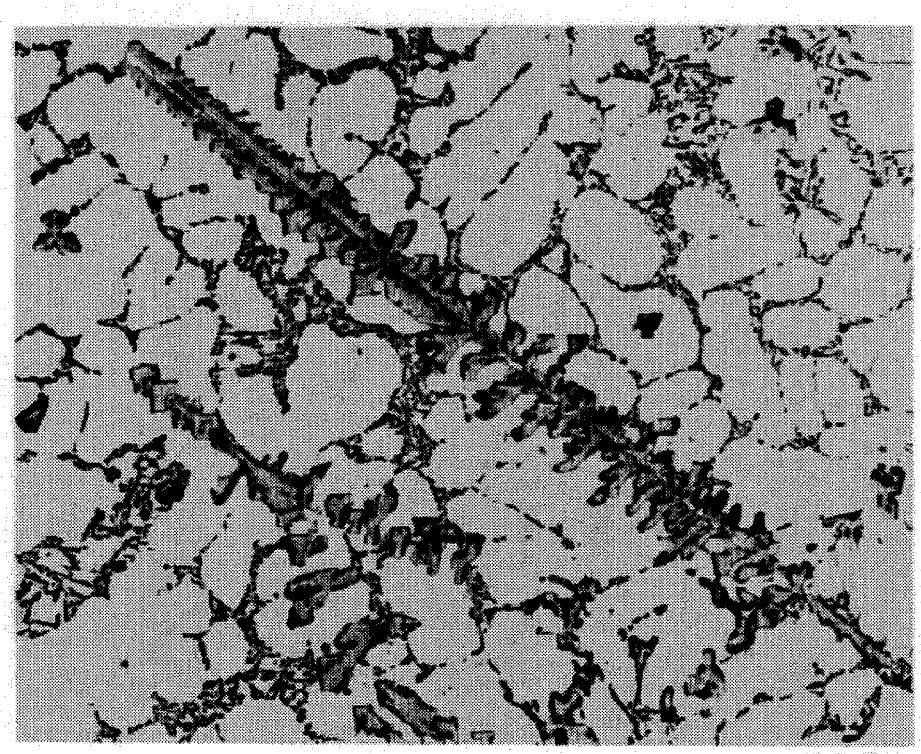
FIG. 10 is a photomicrograph of a further hyper-eutectic alloy casting without refractory particles.
Figure 11:
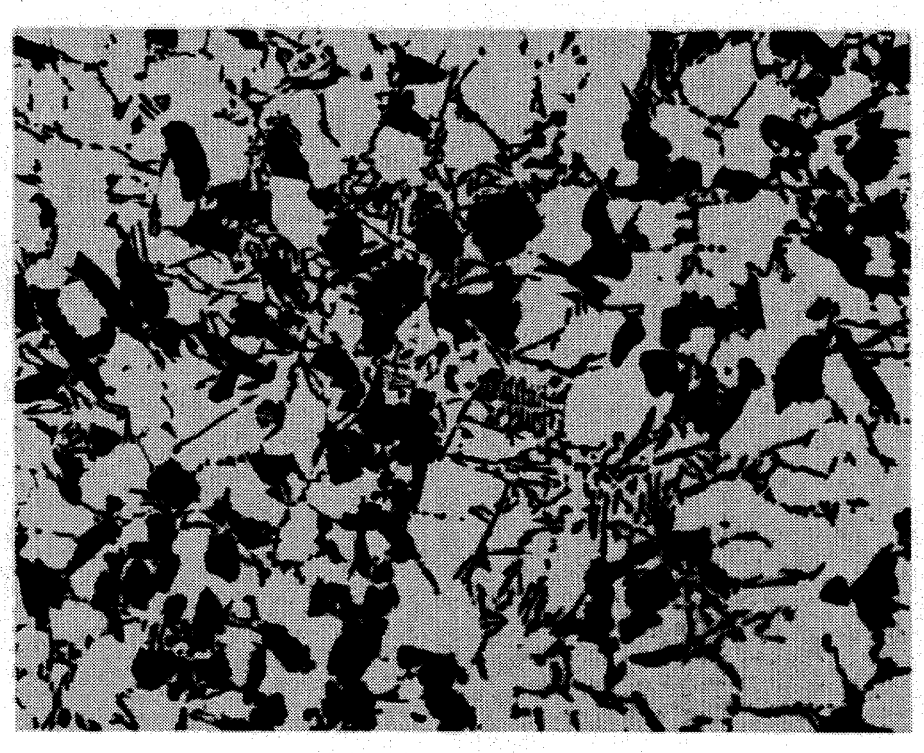
FIG. 11 is a photomicrograph of a casting of the alloy of FIG. 10 with refractory particles.

To illustrate the effectiveness of the refinement according to this invention, the procedure of Example 2 was repeated using a melt of Al-7% Si-2% Mn alloy. One cast ingot was made from the alloy itself and a second cast ingot was made from a composite of the alloy and 15% by volume of silicon carbide particles. FIG. 10 shows the microstructure of the cast alloy and FIG. 11 shows the microstructure of the cast composite. It can be seen that the primary $Mn_3Si_2Al_{15}$ intermetallic dendrites in the cast alloy are completely refined by the SiC particles.

EXAMPLE 7

Three aluminum matrix composites were prepared by mixing 15% by volume of silicon carbide particles having sizes in the range of 10–15 μm with three different aluminum alloy melts. The matrix alloys had the following compositions:

Alloy A: Al-10 wt % Si-1.2 wt % Mn-0.4 wt % Mg

Alloy B: Al-10 wt % Si-1.2 wt % Mn-0.4 wt % Mg-5 wt % Ni

Alloy C: Al-10 wt % Si-1.2 wt % Mn-1.0 wt % Mg-5 wt % Ni-2.5 wt % Cu

The composites so formed were cast and solidified in the form of 12.7 mm diameter as-cast test bars and 57 mm diameter ingots. The as-cast test bars were held for 100 hours at 250° C., and tensile tested at the soak temperature. The 57 mm diameter ingots were extruded at 450° C. to 9.5 mm diameter rod. Test bars were machined from the rod, and held at between 200° and 400° C. for various times to examine the effect of long time exposure on the high temperature strength. The results are shown in FIG. 12–15.

Figure 12:
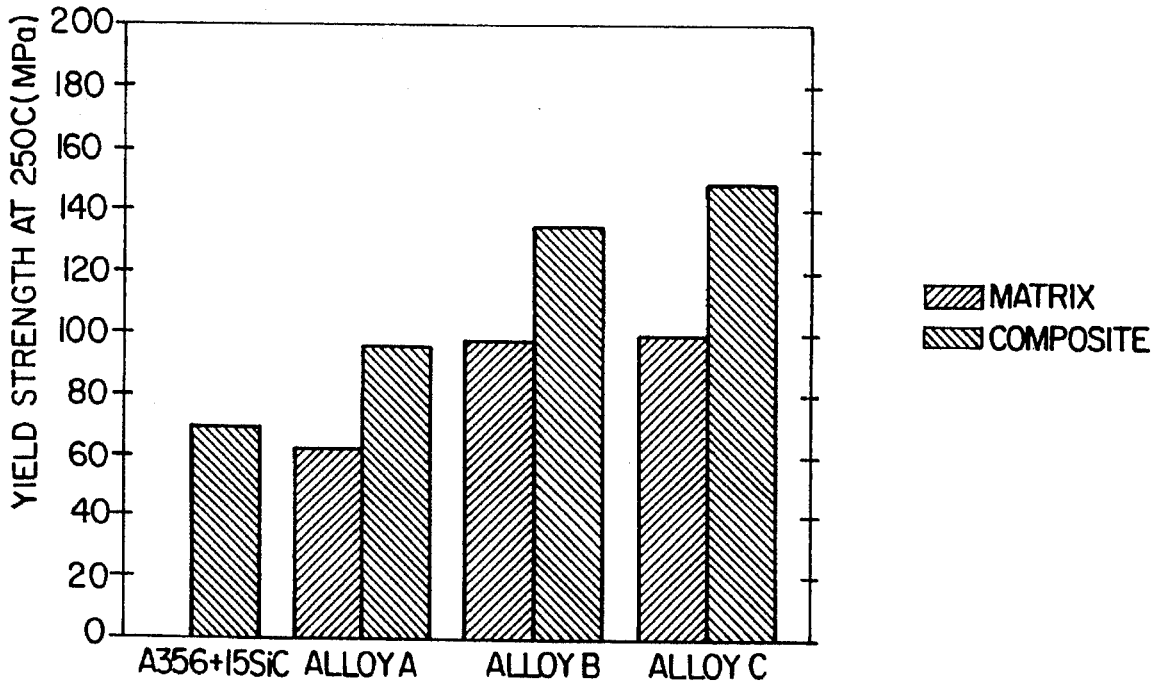
FIG. 12 is bar graphs showing yield strengths of different matrix alloys and composites of the invention.

High temperature composite alloys may be used in casting applications, or as wrought products such as forgings and extrusions. FIG. 12 shows the strength retention of as-cast material after 100 hrs at 250° C., which is relevant for applications such as cast brake rotors. The figure shows that the new alloy composites have superior high temperature strength to the presently used A356-SiC composite. It is also apparent that adding SiC reinforcement to the unreinforced alloys adds to the high temperature performance of these materials.

Figure 13:
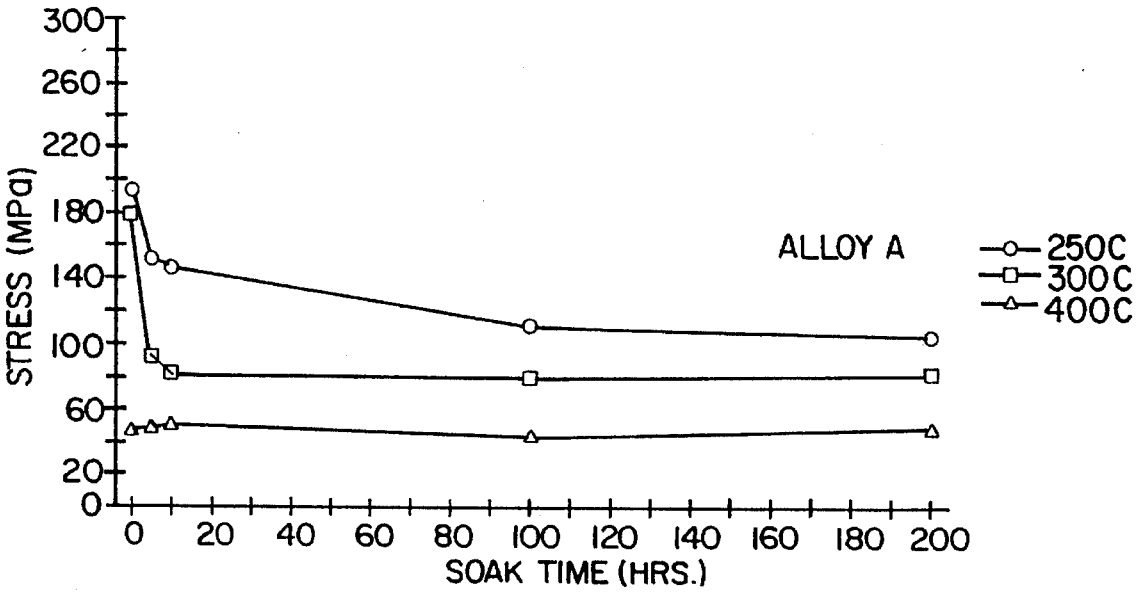
FIGS. 13–15 are plots of stress as a function of soak time for three different cast composites of the invention.
Figure 14:
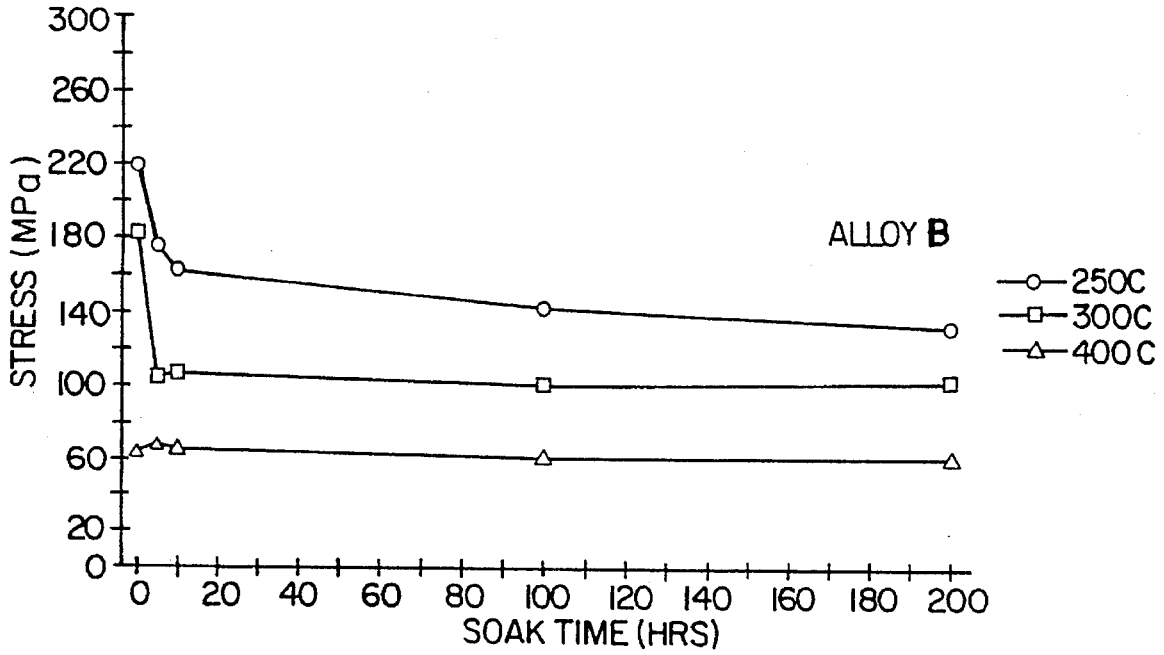
Figure 15:
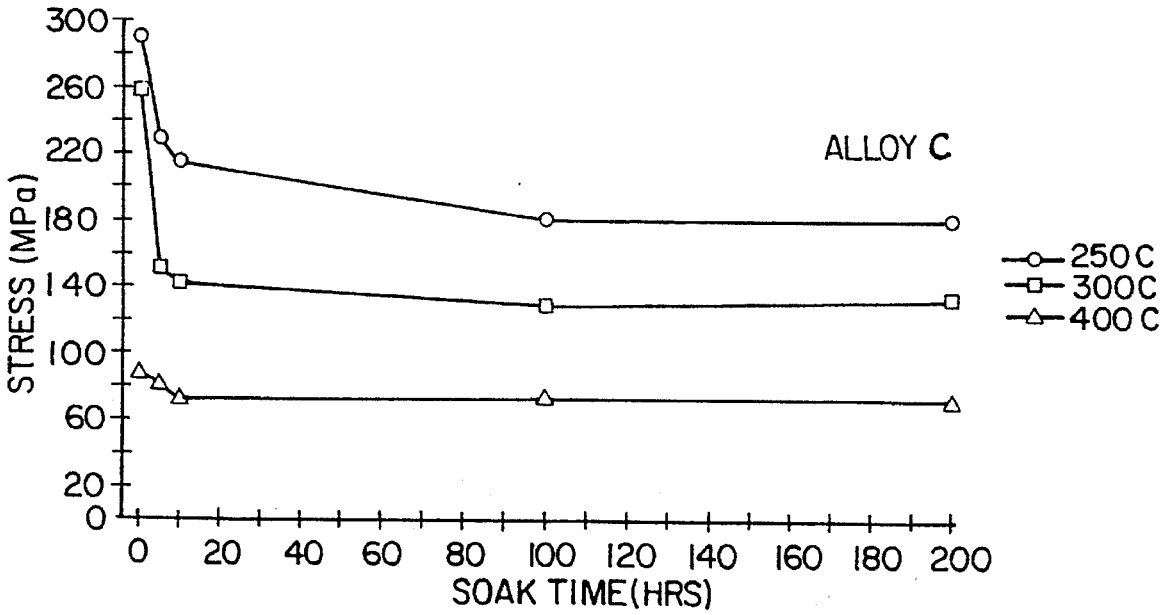

In wrought products additional softening mechanisms, such as sub-structure and grain size coarsening, may operate which are usually absent in as-cast material. FIGS. 13–15 show the time dependence of the softening at 250°, 300° and 400° C. for Alloys A, B and C respectively. All 3 alloys show rapid softening in the first 10 hours of exposure, but beyond this are relatively stable. This initial softening is due to normal, precipitate coarsening and resolution, while after this has occurred the alloys have excellent long term stability. Comparing the extrusion results with those for as-cast test bars in FIG. 12, the extruded composites have somewhat superior strength.

What is claimed is:

1. A refined aluminum alloy casting comprising a hyper-eutectic alloy containing 7–16 percent by weight silicon, 0.3–2.0 percent by weight magnesium and 0.5–3.0 percent by weight manganese and wherein intermetallics formed from excess of alloying elements in the hyper-eutectic alloy during solidification of the casting are nucleated and refined by the presence of non-metallic refractory particles selected from the group consisting of a metal oxide, metal nitride, metal carbide and metal silicide dispersed in the alloy.

2. A refined alloy according to claim 1 wherein the aluminum alloy consisting of, in percentages by weight, 7–16% silicon, 0.3–2.0% magnesium, 0.5–3.0% manganese, 0–5.0% copper, 0–5.0% nickel, 0–1.0% iron and 0–0.2% titanium.

3. A refined alloy according to claim 2 wherein titanium is present in the alloy in an amount of 0.1–0.2%.

4. A refined alloy according to claim 2 wherein the refractory particles comprise silicon carbide.

5. A refined alloy according to claim 4 wherein the silicon carbide particles have sizes of less than 1 μm.

6. A refined alloy according to claim 5 wherein the particles have an aspect ratio in any direction of no more than 5:1.

7. A refined alloy according to claim 6 wherein the particles are present in an amount of 5–40% by volume.

8. An aluminum alloy composite casting comprising a matrix of aluminum alloy reinforced by non-metallic refractory particles selected from the group consisting of a metal oxide, metal nitride, metal carbide and metal silicide, wherein the aluminum alloy is a hyper-eutectic alloy containing 7–16 percent by weight silicon, 0.3–2.0 percent by weight magnesium, and 0.5–3.0 percent by weight manganese and wherein the refractory reinforcing particles are engulfed by intermetallics formed from excess of alloying elements in the hyper-eutectic alloy during solidification of the casting and thereby uniformly dispersed in the matrix.

9. A composite casting according to claim 8 wherein the aluminum alloy consists of, in percentages by weight, 7–16% silicon, 0.3–2.0% magnesium, 0.5–3.0% manganese, 0–5.0% copper, 0–5.0% nickel, 0–1.0% iron and 0–0.2% titanium.

10. A composite casting according to claim 9 wherein titanium is present in the alloy in an amount of 0.1–0.2%.

11. A composite casting according to claim 9 wherein the refractory particles comprise silicon carbibe.

12. A composite casting according to claim 11 wherein the silicon carbide particles have size up to 20 μm.

13. A composite casting according to claim 12 wherein the silicon carbide particles have sizes in the range 10–15 μm.

14. A composite casting according to claim 13 wherein the particles have an aspect ratio in any direction of no more than 5:1.

15. A composite casting according to claim 14 wherein the particles are present in an amount of 5–40% by volume.

16. A method for preparing a refined eutectic or hyper-eutectic metal alloy, comprising:

melting an eutectic or hyper-eutectic aluminum alloy containing 7–16 percent by weight silicon, 0.3–2.0 percent by weight magnesium and 0.5–3.0 percent by weight manganese;

adding non-metallic refractory particles selected from the group consisting of a metal oxide, metal nitride, metal carbide and metal silicide to the molten aluminum matrix;

mixing together the molten aluminum alloy and the refractory particles; and casting the resulting mixture under conditions causing at least one intermetallic phase to solidify first from the molten aluminum alloy matrix during solidification thereof such that the intermetallics formed during solidification wet and engulf said refractory particles.

17. A method for preparing a composite of a metallic alloy matrix reinforced with non-metallic refractory particles selected from the group consisting of a metal oxide, metal nitride, metal carbide and metal silicide, comprising:

melting an eutectic or hyper-eutectic aluminum alloy containing 7–16 percent by weight silicon, 0.3–2.0 percent by weight magnesium and 0.5–3.0 percent by weight manganese;

adding the refractory particles selected from the group consisting of a metal oxide, metal nitride, metal carbide and metal silicide to the molten alloy;

mixing together the molten alloy and the refractory particles; and casting the resulting mixture under conditions causing at least one intermetallic phase to solidify first from the molten alloy during solidification thereof such that the refractory particles are wetted and engulfed by the intermetallic phase as it grows during solidification.

18. A method for preparing a refined hyper-eutectic metal alloy, comprising:

melting a hyper-eutectic aluminum alloy containing 7–16 percent by weight silicon, 0.3–2.0 percent by weight magnesium and 0.5–3.0 percent by weight manganese;

adding non-metallic refractory particles selected from the group consisting of a metal oxide, metal nitride, metal carbide and metal silicide to the molten metal matrix;

mixing together the molten metal alloy and the refractory particles, and;

casting the resulting mixture whereby at least one intermetallic phase forms from excess of alloying elements in the hyper-eutectic alloy and solidifies from the molten metal matrix during solidification thereof such that the intermetallics formed during solidification wet and engulf said refractory particles.

19. A method according to claim 18 wherein the refractory particles comprise silicon carbide.

20. A method according to claim 18 wherein the intermetallics are selected from the group consisting of Si, $FeSiAl_5$, $Fe_2SiAl_8$, $Mn_3Si_2Al_{15}$, $NiAl_3$ and $Mg_2Si$.

21. A method according to claim 18 wherein refractory particles have sizes up to 20 microns.

22. A method according to claim 18 wherein the refractory particles have sizes of less than one micron.

23. A method according to claim 22 wherein the refractory particles nucleate and refine the intermetallics.

24. A method for preparing a composite of a metallic alloy matrix reinforced with non-metallic refractory particles, comprising:

melting a hyper-eutectic aluminum alloy containing 7–16 percent by weight silicon, 0.3–2.0 percent by weight magnesium and 0.5–3.0 percent by weight manganese;

adding the refractory particles selected from the group consisting of a metal oxide, metal nitride, metal carbide and metal silicide to the molten alloy;

mixing together the molten metal alloy and the refractory particles, and;

casting the resulting mixture whereby at least one intermetallic phase forms from excess of alloying elements in the hyper-eutectic alloy and solidifies from the molten alloy during solidification thereof such that the refractory particles are wetted and engulfed by the intermetallic phase as it grows during solidification.

25. A method according to claim 24 wherein the refractory particles comprise silicon carbide.

26. A method according to claim 24 wherein the intermetallics are selected from the group consisting of Si, $Fe_2SiAl_8$, $FeSiAl_5$, $Mn_3Si_2Al_{15}$, $NiAl_3$ and $Mg_2Si$.

27. The method according to claim 24 wherein the refractory particles have sizes in the range of 10–15 microns.

28. A method according to claim 18, wherein said aluminum alloy contains 0–1.0 percent by weight iron.

29. A method according to claim 24, wherein said aluminum alloy contains 0–1.0 percent by weight iron.

30. A casting according to claim 8, wherein said aluminum alloy contains 0–1.0 percent by weight iron.

31. A casting according to claim 1, wherein said aluminum alloy contains 0–1.0 percent by weight iron.

32. A method according to claim 16, wherein said aluminum alloy contains 0–1.0 percent by weight iron.

33. A method according to claim 17, wherein said aluminum alloy contains 0–1.0 percent by weight iron.

* * * * *